US009266334B2

(12) United States Patent
Ibe et al.

(10) Patent No.: US 9,266,334 B2
(45) Date of Patent: Feb. 23, 2016

(54) INKJET RECORDING APPARATUS AND CONTROL METHOD FOR THE INKJET RECORDING APPARATUS

(71) Applicant: CANON KABUSHIKI KAISHA, Tokyo (JP)

(72) Inventors: Tsuyoshi Ibe, Yokohama (JP); Masaya Uetsuki, Yokohama (JP); Toshimitsu Danzuka, Tokyo (JP); Masataka Kato, Yokohama (JP); Asako Tomida, Kawasaki (JP); Hiroaki Komatsu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/275,619

(22) Filed: May 12, 2014

(65) Prior Publication Data

US 2014/0340446 A1 Nov. 20, 2014

(30) Foreign Application Priority Data

May 15, 2013 (JP) ..... 2013-103450

(51) Int. Cl.
*B41J 2/165* (2006.01)

(52) U.S. Cl.
CPC ..... *B41J 2/16535* (2013.01); *B41J 2002/1655* (2013.01); *B41J 2002/16558* (2013.01)

(58) Field of Classification Search
USPC ..... 347/5, 9, 14, 15, 23, 33, 29
See application file for complete search history.

(56) References Cited

U.S. PATENT DOCUMENTS

| | | | | |
|---|---|---|---|---|
| 6,692,100 | B2 | 2/2004 | Steinfield | |
| 8,342,639 | B2 * | 1/2013 | Inoue | 347/33 |
| 2005/0052489 | A1 * | 3/2005 | Kim et al. | 347/29 |
| 2006/0109295 | A1 * | 5/2006 | Kusunoki | 347/15 |
| 2006/0192804 | A1 | 8/2006 | Nakata et al. | |
| 2009/0109258 | A1 | 4/2009 | Nitta et al. | |
| 2012/0194610 | A1 | 8/2012 | Kyoso | |
| 2014/0035996 | A1 | 2/2014 | Gros Gras et al. | |

FOREIGN PATENT DOCUMENTS

| | | | |
|---|---|---|---|
| CN | 102649362 | A | 8/2012 |
| JP | 2004-299065 | A | 10/2004 |
| JP | 2010-280067 | A | 12/2010 |
| JP | 2012-051142 | A | 3/2012 |
| JP | 2012-218355 | A | 11/2012 |
| JP | 2013-001070 | A | 1/2013 |

* cited by examiner

*Primary Examiner* — Lam Nguyen
(74) *Attorney, Agent, or Firm* — Canon USA, Inc. IP Division

(57) ABSTRACT

While a wiping operation for keeping a satisfactory ejection opening surface of an inkjet recording head is performed, a usage amount of a sheet-like member is to be reduced. An inkjet recording apparatus includes a recording head, a sheet-like member, a reeling roller that reels the sheet-like member 31, and a measurement unit that measures an ejection number of ink ejected from the recording head. A control is performs to cause the reeling roller 32 to reel the sheet-like member 31 in accordance with the ejection number of the ink which is measured by the measurement unit.

19 Claims, 18 Drawing Sheets

| RECIPROCATION NUMBER | 1 | 2 | 3 | 4 | 5 | 6 | 7 | 8 | 9 | 10 | 11 |
|---|---|---|---|---|---|---|---|---|---|---|---|
| EJECTION NUMBER | 6.0E+07 | 8.0E+07 | 1.0E+08 | 1.2E+08 | 1.4E+08 | 1.6E+08 | 1.8E+08 | 2.0E+09 | 2.2E+09 | 2.4E+09 | 2.6E+09 |
| WIPING CAPABILITY | ○ | ○ | ○ | ○ | ○ | ○ | ○ | ○ | ○ | ○ | × |

FIG. 7C

| EJECTION NUMBER | | WIPING OPERATION THRESHOLD (DL) | REELING OPERATION EXECUTION DETERMINATION |
|---|---|---|---|
| $D_T1$ | $1\times10^9$ | $2.0\times10^9$ | NO EXECUTION |
| $D_T2$ | $1.5\times10^9$ | | NO EXECUTION |
| $D_T3$ | $2.5\times10^9$ | | EXECUTION |
| $D_T4$ | $1.5\times10^9$ | | NO EXECUTION |
| $D_T5$ | $3\times10^9$ | | EXECUTION |

FIG. 8C

| | EJECTION NUMBER OF EACH COLOR | | | | | | MAXIMUM EJECTION NUMBER (Dmax) | WIPING OPERATION THRESHOLD (DLmax) | REELING OPERATION EXECUTION DETERMINATION |
|---|---|---|---|---|---|---|---|---|---|
| | Bk | Lc | C | Lm | M | Y | | | |
| D1 | $5\times10^{7}$ | $5\times10^{7}$ | $5\times10^{7}$ | $5\times10^{7}$ | $5\times10^{7}$ | $5\times10^{7}$ | $5\times10^{7}$ | $5\times10^{8}$ | NO EXECUTION |
| D2 | $1\times10^{8}$ | $1\times10^{8}$ | $1\times10^{8}$ | $2.5\times10^{8}$ | $1\times10^{8}$ | $1\times10^{8}$ | $2.5\times10^{8}$ | | NO EXECUTION |
| D3 | $2.5\times10^{8}$ | $1.5\times10^{8}$ | $3.5\times10^{8}$ | $5.5\times10^{8}$ | $2.5\times10^{8}$ | $1.5\times10^{8}$ | $5.5\times10^{8}$ | | EXECUTION |
| D4 | $1\times10^{8}$ | $5\times10^{7}$ | $1.5\times10^{8}$ | $5\times10^{7}$ | $5\times10^{7}$ | $1\times10^{8}$ | $1.5\times10^{8}$ | | NO EXECUTION |
| D5 | $1.5\times10^{8}$ | $1\times10^{8}$ | $5\times10^{8}$ | $2.5\times10^{8}$ | $6\times10^{7}$ | $2\times10^{8}$ | $5\times10^{8}$ | | EXECUTION |

FIG. 11C

| | EJECTION NUMBER OF EACH COLOR | | | MAXIMUM EJECTION NUMBER ($D_A$max) | WIPING OPERATION THRESHOLD ($DL_A$max) | REELING OPERATION EXECUTION DETERMINATION |
|---|---|---|---|---|---|---|
| | AREA A | AREA B | AREA C | | | |
| $D_A1$ | $5\times10^9$ | $5\times10^9$ | $5\times10^9$ | $5\times10^9$ | $2\times10^{10}$ | NO EXECUTION |
| $D_A2$ | $1\times10^{10}$ | $1\times10^{10}$ | $1\times10^{10}$ | $1\times10^{10}$ | | NO EXECUTION |
| $D_A3$ | $2.5\times10^{10}$ | $6\times10^{10}$ | $3.5\times10^{10}$ | $6\times10^{10}$ | | EXECUTION |
| $D_A4$ | $1\times10^{10}$ | $5\times10^9$ | $1.5\times10^{10}$ | $1.5\times10^{10}$ | | NO EXECUTION |
| $D_A5$ | $1.5\times10^{10}$ | $1\times10^{10}$ | $5\times10^{10}$ | $5\times10^{10}$ | | EXECUTION |

INKJET RECORDING APPARATUS AND CONTROL METHOD FOR THE INKJET RECORDING APPARATUS

BACKGROUND OF THE INVENTION

1. Field of the Invention

The present invention relates to an inkjet recording apparatus and a control method for the inkjet recording apparatus.

2. Description of the Related Art

When ink is ejected from an ejection opening of a recording head of an inkjet recording apparatus, ink mist that is not landed on a recording medium is generated. The ink mist is deposited on an ejection opening surface of the recording head or the like and may prevent the ink ejected from the ejection opening from landing at a normal position. The ink mist deposited on the ejection opening surface is normally removed by a wiper blade.

In recent years, a technology for solidifying the ink on the recording medium by using ultraviolet rays, micro waves, heat, or the like has been developed to perform recording on the recording medium that does not have an ink receptor layer. In the above-described configuration, thermal fixing ink or the like which is easily be solidified on the recording medium by the heat or the like is used. According to such configuration too, the ink mist deposited on the ejection opening surface is firmly solidified on the ejection opening surface and may prevent the ink from the ejection opening from landing at a normal position. Since the ink mist according to the above-described inkjet recording technology is firmly solidified, it is difficult to remove the ink mist by a normal wiper blade in some cases.

U.S. Pat. No. 6,692,100 discloses a recording apparatus in which a sheet-like member is supplied to a position facing the ejection opening surface, and this sheet-like member is abutted against the ejection opening surface to perform wiping, so that the ejection opening surface is cleaned. U.S. Pat. No. 6,692,100 also discloses that the sheet-like member that has once been used for the wiping is reeled by a reeling roller, so that an unused part of the sheet-like member is supplied to the position facing the ejection opening surface.

Incidentally, since the sheet-like member is reeled for every wiping operation in the recording apparatus according to U.S. Pat. No. 6,692,100, even a site of sheet-like member where the contamination is moderate and the ejection opening surface can be cleaned again may be reeled in some cases. To elaborate, the sheet-like member is not reeled at an appropriate timing in accordance with a degree of contamination of the sheet-like member in the recording apparatus according to U.S. Pat. No. 6,692,100, and much of the sheet-like member may be consumed beyond necessity.

On the other hand, it is also conceivable to perform the reeling operation for every certain number of the wiping operations, but in such case, much of the contamination caused by the wiping operation is accumulated at a predetermined site of the sheet-like member. For this reason, even when the wiping operation is performed at this predetermined site, the ink solidified on the ejection opening surface may not sufficiently be removed.

SUMMARY OF THE INVENTION

According to an aspect of the present invention, there is provided an inkjet recording apparatus that can reduce a use amount of the sheet-like member by performing a control to reel the sheet-like member at an appropriate timing while the wiping operation for keeping the satisfactory ejection opening surface is performed.

According to another aspect of the present invention, there is provided an inkjet recording apparatus including: an inkjet recording head including an ejection opening surface from which ink is ejected; a wiping unit configured to wipe the ejection opening surface; a changing unit configured to perform a changing operation for changing a wiping area of the wiping unit; an obtaining unit configured to obtain a value related to an ink amount ejected from the inkjet recording head; and a control unit configured to cause the changing unit to perform the changing operation on the basis of the value related to the ink amount which is obtained by the obtaining unit.

Further features of the present invention will become apparent from the following description of exemplary embodiments with reference to the attached drawings.

BRIEF DESCRIPTION OF THE DRAWINGS

FIGS. 7A to 7C are a flow chart of a wiping operation, a schematic diagram of reeling timings in a case where the flow chart of FIG. 7A is executed, and a table of an ejection number, a wiping operation threshold, and a reeling operation execution determination according to a first exemplary embodiment.

FIGS. 8A to 8C are a flow chart of a wiping operation are, a schematic diagram of reeling timings in a case where the flow chart of FIG. 8A is executed, and a table of an ejection number of each color, a maximum ejection number, a wiping operation threshold, and a reeling operation execution determination according to a second exemplary embodiment.

FIGS. 11A to 11C are a flow chart of a wiping operation, a schematic diagram of reeling timings in a case where the flow chart of FIG. 7A is executed, and a table of an ejection number of each area, a maximum ejection number, a wiping operation threshold, and a reeling operation execution determination according to the third exemplary embodiment.

DESCRIPTION OF THE EMBODIMENTS

Hereinafter, exemplary embodiments of the present invention will be described with reference to the drawings.

First Exemplary Embodiment

Figure 1A:
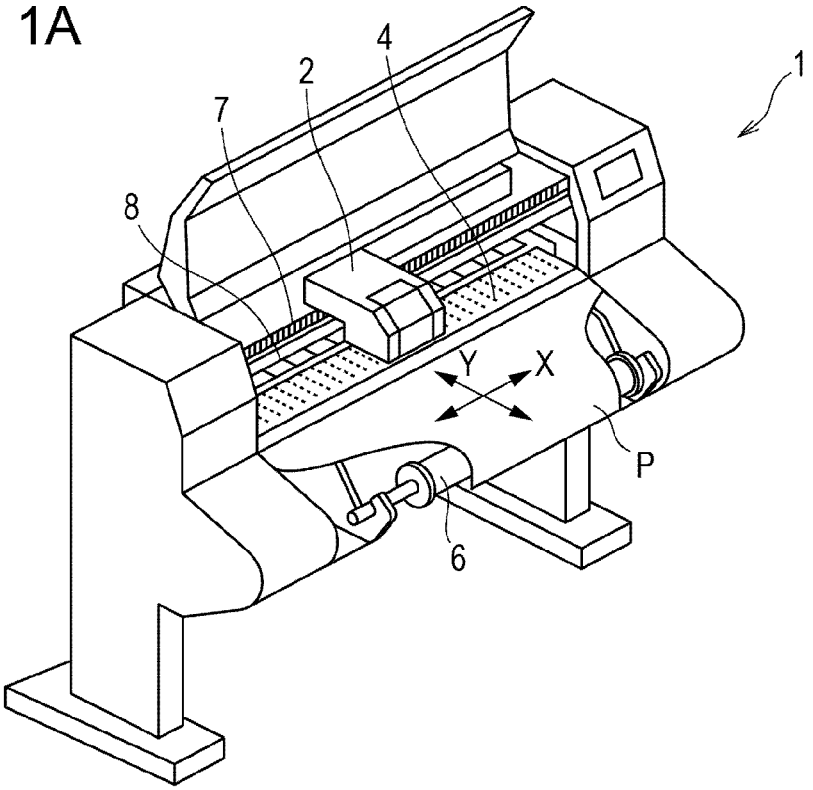
FIGS. 1A and 1B are schematic diagrams of an inkjet recording apparatus and a recording head according to exemplary embodiments of the present invention.

FIG. 1A is a schematic diagram of an inkjet recording apparatus 1 according to the present exemplary embodiment. The inkjet recording apparatus 1 includes a carriage 2 to which a recording head 9 which will be described below is mounted. The recording head 9 is an inkjet recording head. A recording operation is performed by moving the carriage 2 in a main scanning direction X. The main scanning direction X is a direction intersecting with a conveyance direction Y a recording medium P.

The recording medium P is held at a spool 6. The recording medium P held in the spool 6 is conveyed towards a platen 4 by a feed roller which is not illustrated in the drawing. The feed roller is driven by a feed motor 5 which will be described below. The recording medium P is conveyed along the conveyance direction Y on the platen 4.

When the recording medium P is conveyed to a recording position facing the recording head 9 mounted to the carriage 2, the carriage 2 is moved in the main scanning direction X along a guide shaft 8. During this movement, ink is ejected from the recording head 9. Ejection opening columns 11 to 16 which will be described are provided on the recording head 9. While the ink is ejected from the ejection opening columns 11 to 16, a recording operation is performed at certain band widths corresponding to ranges of the ejection opening columns 11 to 16. A timing at which the ink is ejected is determined on the basis of a position signal obtained by an encoder 7.

After the recording operation at the recording position is ended, the recording medium P is conveyed at a predetermined amount along the conveyance direction Y, and a new area of the recording medium P faces the recording head 9. The recording operation is also performed at the certain band widths corresponding to the ranges of the ejection opening columns 11 to 16 on the new area of the recording medium P.

Figure 1B:
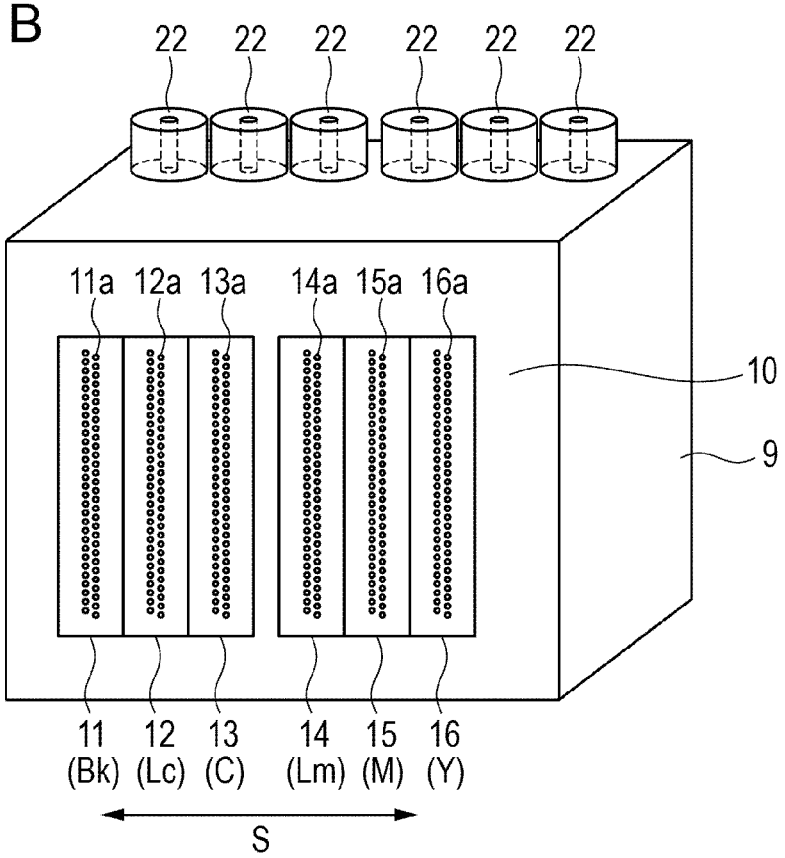

FIG. 1B is a schematic diagram of the recording head 9 mounted to the carriage 2. Ejection opening columns 11 to 16 from which ink of different color tones is ejected are provided on an ejection opening surface 10 of the recording head 9. This ink color tone also includes different colors and different densities. The ejection opening columns 11 to 16 are provided along the main scanning direction X.

The ejection opening columns 11 to 16 are respectively constituted by a plurality of ejection openings 11*a* to 16*a*. The ejection openings 11*a* to 16*a* are respectively arranged in the conveyance direction Y. Ink colors are, for example, black (Bk), light cyan (Lc), cyan (C), light magenta (Lm), magenta (M), and yellow (Y). The ejection openings 11*a* to 16*a* eject ink of a color allocated to each ejection opening among the ink of the plurality of colors. The ejection openings 11*a* to 16*a* eject the ink by head generated by a heater. The ink may be fixed on the recording medium P by the heat.

The ink is supplied to the ejection openings 11*a* to 16*a* from ink introduction units 22 via ink paths inside the recording head 9. The ink is supplied from an ink tank 14 which will be described below to the ink introduction units 22 via a tube 13 which will be described below.

Figure 2:
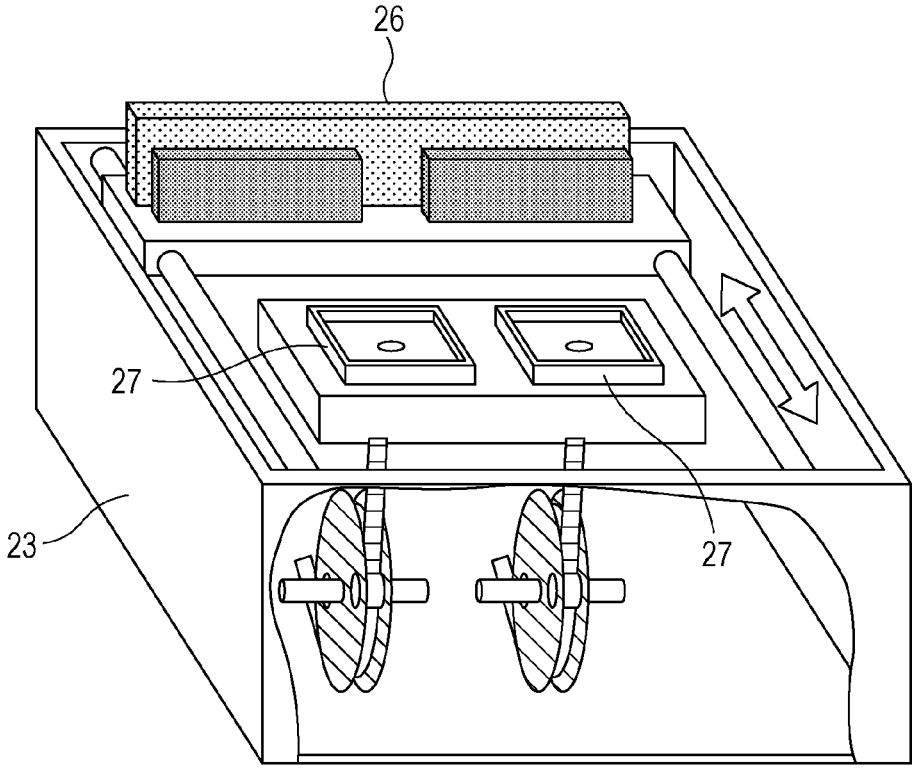
FIG. 2 is a schematic diagram of a recovery unit.

FIG. 2 is a schematic diagram of a recovery unit 23. In FIG. 1A, a home position and a back position are respectively set on an extension line of both ends of the platen 4 arranged along the main scanning direction X. The carriage 2 stops at the home position or the back position as appropriate during the recording operation or between the recording operations. The recovery unit 23 is arranged in the vicinity of the home position.

The recovery unit 23 includes a wiper 26, a cap 27, and the like. The cap 27 is elevated and lowered by an elevating and lowering mechanism which is not illustrated in the drawing. When the cap 27 is elevated, the ejection opening surface 10 is capped.

Figure 3:
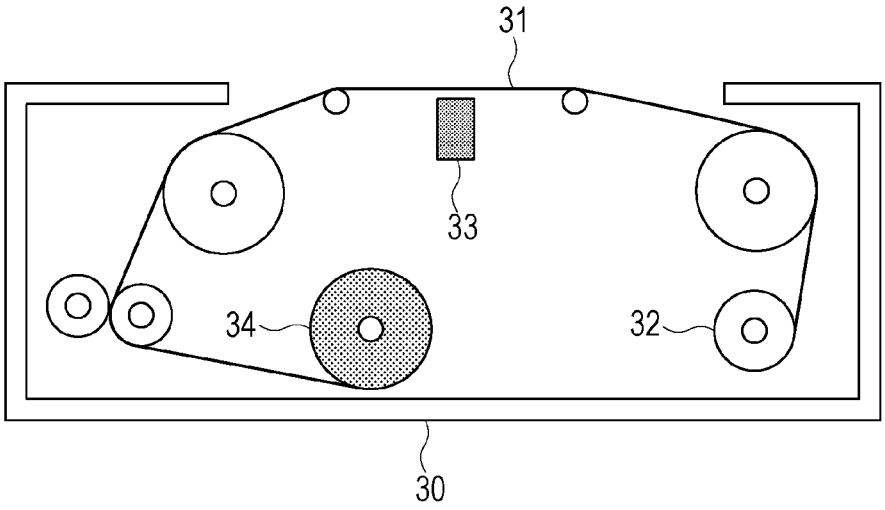
FIG. 3 is a schematic diagram of a wiping unit.

FIG. 3 is a schematic diagram of a wiping unit 30. The wiping unit 30 includes a sheet-like member 31, a reeling roller 32, an abutting member 33, and a feed roller 34. The sheet-like member 31 is a non-woven fabric or the like using porous urethane foam, melamine foam, polyolefin, or PET, nylon, or the like. The sheet-like member 31 is impregnated with wiping solution including water, surfactant, solvent, or the like.

The sheet-like member 31 is pressed up by the abutting member 33, so that the sheet-like member 31 abuts against the ejection opening surface 10. Next, the ejection opening surface 10 and the wiping unit 30 are relatively moved in a state in which the sheet-like member 31 abuts against the ejection opening surface 10, so that the ejection opening surface 10 is wiped by the sheet-like member 31.

By reeling the sheet-like member 31 by the reeling roller 32, a portion of the sheet-like member 31 at a position facing the ejection opening surface 10 is reeled. This site of the sheet-like member 31 at the position facing the ejection opening surface 10 corresponds to a wiping area for wiping the ejection opening surface 10.

Figure 4:
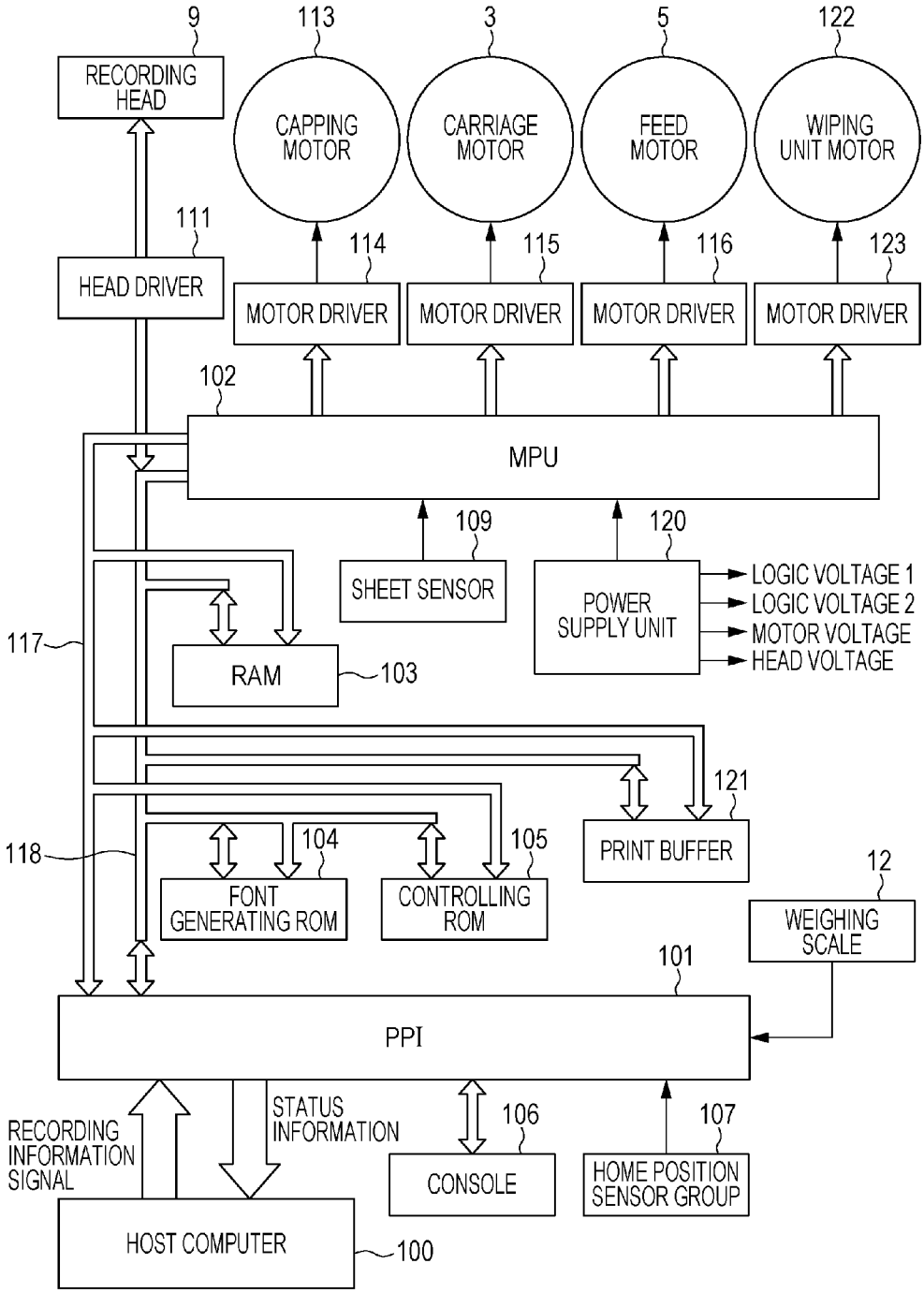
FIG. 4 is a block diagram of a control unit.

FIG. 4 is a block diagram of a control circuit 130 of the inkjet recording apparatus 1. A programmable peripheral interface (PPI) 101 receives a recording information signal transmitted from a host computer 100. This recording information signal includes recording data. The recording information signal received by the PPI 101 is transferred to an MPU 102. The PPI 101 transmits status information of the inkjet recording apparatus 1 to the host computer 100 as appropriate. Furthermore, the PPI 101 performs input and output with a console 106 and receives a signal input from a home position sensor group 107.

The console 106 includes a setting input unit for a user to perform various settings of the inkjet recording apparatus 1 and a display unit that displays a message to the user. The home position sensor group 107 includes a home position sensor that detects that the carriage 2 is at the home position, a capping sensor that detects that the ejection opening surface 10 is capped by the cap 27, and the like.

The MPU 102 controls the inkjet recording apparatus 1 while following a control program stored in a controlling ROM 105. A RAM 103 is used as a work area of the MPU 102 and stores received signals to temporarily store various data. A font generating ROM 104 stores pattern information such as a character or a record corresponding to code information and outputs various pattern information corresponding to input code information. The print buffer 121 stores a storage capacity for a predetermined number of rows of the recording data and temporarily stores the recording data expanded to the RAM 103 or the like.

The ejection number of the ink ejected from the recording head 9 is measured by the MPU 102 or the like from the stored data in the print buffer 121 or the like.

The controlling ROM 105 can also store fixed data corresponding to data used in the control. Herein, the data used in the control is data for determining on whether the wiping operation is performed or the like.

The RAM 103, the font generating ROM 104, the controlling ROM 105, and the print buffer 121 are controlled by the MPU 102 via an address bus 117 and a data bus 118.

A capping motor 113 is a drive source for the elevating and lowering operation of the cap 27, the movement operation of the wiper 26, or the like. A carriage motor 3 moves the carriage 2. The feed motor 5 conveys the recording medium P along the conveyance direction Y. A wiping unit motor 122 rotates the reeling roller 32 and collects the sheet-like member 31 into the reeling roller 32. Motor drives 114, 115, 116, and 123 respectively drive the capping motor 113, the carriage motor 3, the feed motor 5, and the wiping unit motor 122 in accordance with a control of the MPU 102.

A sheet sensor 109 detects a leading end and a trailing end of the recording medium P. A head driver 111 drives a recording element of the recording head 9 in accordance with the recording information signal transmitted from the host computer 100. A power supply unit 120 supplies power to each unit of the control circuit 130. The power supply unit 120 includes an AC adopter and a battery as a drive power supply apparatus.

A weighing scale 12 weighs a weight of the ink tank 14 which will be described below and transmits a measurement result to the PPI 101.

Figure 5A:
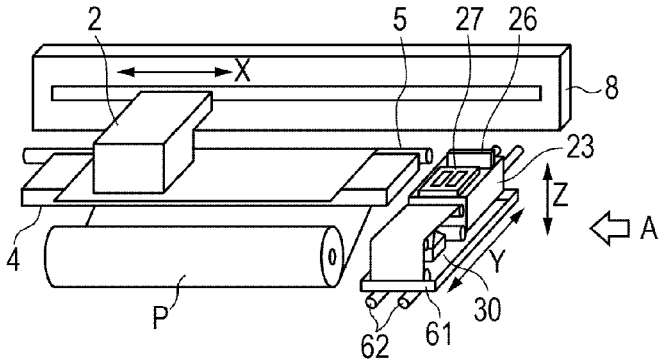
FIGS. 5A to 5D are schematic diagrams of an internal mechanism and a wiping operation of the inkjet recording apparatus.

FIG. 5A is a schematic diagram of an internal mechanism of the inkjet recording apparatus 1. As illustrated in FIG. 5A, the recovery unit 23 and the wiping unit 30 are arranged on the home position side and fixed on a moving platform 61. The moving platform 61 is moved in the conveyance direction Y along a slide guide 62. The wiping unit 30 performs the wiping operation in a direction along the ejection opening columns 11 to 16 (the array direction of the ejection openings.

Figure 5B:
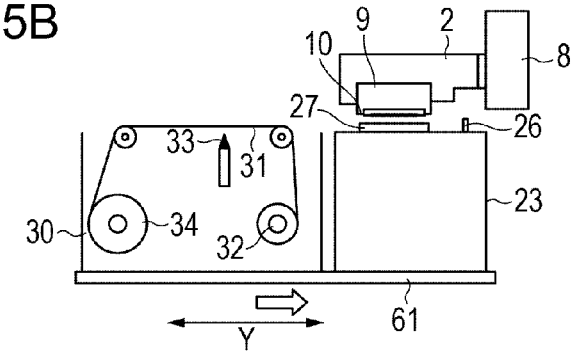
Figure 5C:
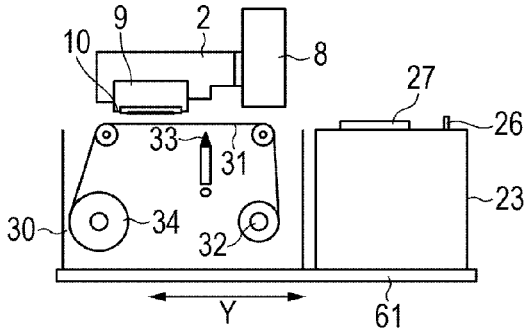
Figure 5D:
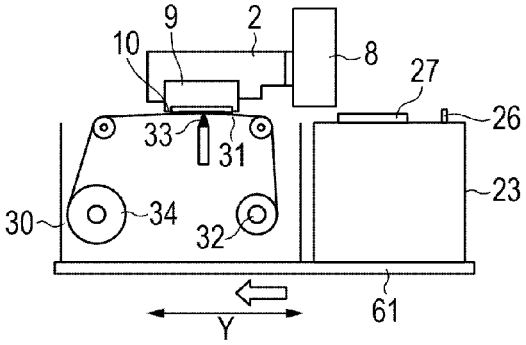

FIGS. 5B to 5D are schematic diagrams of the wiping operation by the wiping unit 30 as seen from an arrow A direction of FIG. 5A. As illustrated in FIG. 5A, since the cap 27 is located at a distance from the ejection opening surface 10, the carriage 2 can perform a movement in the main scanning direction X.

When it is determined that the recording data for the one scanning is accumulated in the print buffer 121, while the carriage 2 is moved from the home position to the back position, the recording operation for the one scanning is executed. After the start of the recording operation, while the moving platform 61 is moved in the conveyance direction Y, the wiping unit 30 is located on the extension line in the main scanning direction X of the platen 4. This is because auxiliary ejection of the ink is performed towards the wiping unit 30 from the recording head 9 mounted to the carriage 2. When it is determined that the recording data for the next one scanning is accumulated in the print buffer 121, while the carriage 2 is moved from the back position to the home position, the recording operation for the one scanning is executed. After the execution of the recording operation for the two scannings by this reciprocating operation, the wiping operation by the wiping unit 30 is executed.

In the wiping operation, first, as illustrated in FIG. 5A, the carriage 2 is moved to the position facing the wiping unit 30 and then stops. In a state in which the carriage 2 stops at the position facing the wiping unit 30, the abutting member 33 is elevated from the evacuating position to the elevated position to be fixed. The elevated position refers to a position where the sheet-like member 31 can contact the ejection opening surface 10. Next, as illustrated in FIG. 5D, while the moving platform 61 is moved in the Y direction in a state in which the abutting member 33 is fixed at the elevated position, the ejection opening surface 10 is wiped by the sheet-like member 31 in the direction along the ejection opening columns (array direction of the ejection openings). At this time, the abutting member 33 is fixed at the elevated position until the abutting member 33 passes through the ejection opening surface 10 of the recording head 9. After the abutting member 33 passes through the ejection opening surface 10, the abutting member 33 is lowered from the elevated position to the evacuating position.

The used area of the sheet-like member 31 is collected by rotating the reeling roller 32. By executing a changing operation for reeling the used area, an unused area of the sheet-like member 31 faces the ejection opening surface 10.

Figures 6A, 6B:
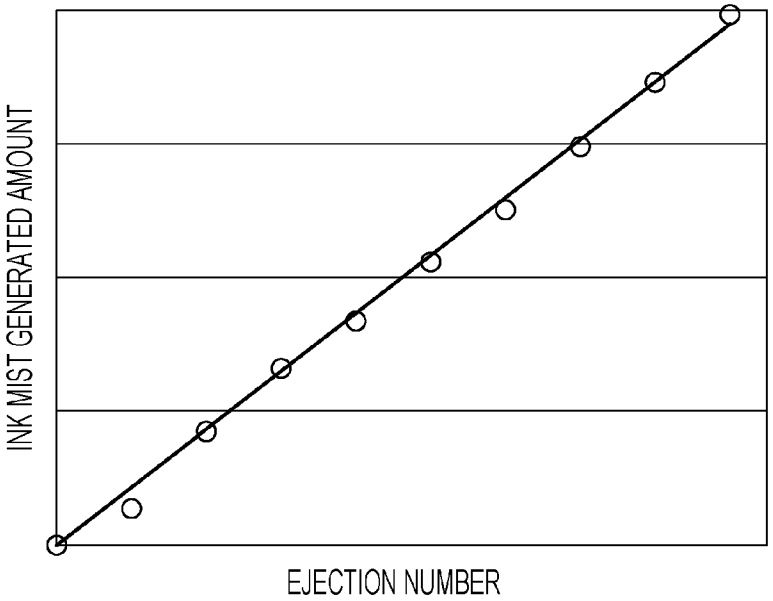
FIGS. 6A and 6B are a relationship diagram between an ejection number and a generation amount of ink mist and a calculation example of a wiping operation threshold.

FIG. 6A illustrates a relationship between an ejection number of the ink from the ejection opening and a generation amount of ink mist in the inkjet recording apparatus. As illustrated in FIG. 6A, the generation amount of the ink mist is increased in proportion to an increase in the ejection number of the ink. When the generation amount of the ink mist is increased, the ink mist amount deposited on the ejection opening surface 10 is also increased. With this condition, according to the present exemplary embodiment, the ink mist amount deposited on the ejection opening surface 10 is estimated by measuring the ejection number.

FIG. 6B is a table of a relationship between the ejection number of the ink and the presence or absence of a wiping capability of the wiping area. Herein, the wiping capability indicates a performance with which an ejection fault of the ejection opening of the ejection opening surface 10 can be eliminated by the wiping operation. FIG. 6B illustrates the reciprocation number of the reciprocation operations by the recording head 9 and the ejection number of the ink ejected while the reciprocation operations are performed for the reciprocation number. The presence or absence of the wiping capability is determined after the reciprocation operations for the reciprocation number.

As illustrated in FIG. 6B, the wiping area of the sheet-like member 31 has the wiping capability when the ejection number by the reciprocation number at 10 times is $2.4\times10^9$. That is, the wiping area of the sheet-like member 31 has the capability of wiping the ejection opening surface 10 after the reciprocation operation performed by 10 times. The wiping area of the sheet-like member 31 loses the wiping capability when the ejection number is $2.6\times10^9$ by the reciprocation number at 11 times. That is, the wiping area of the sheet-like member 31 loses the capability of wiping the ejection opening surface 10 after the reciprocation operations are performed for 11 times. In view of the above, a value of an upper limit at which the wiping capability is present is determined as $2.0\times10^9$ while taking into account a variation of the apparatuses and the like and a safety factor.

Figure 7A:
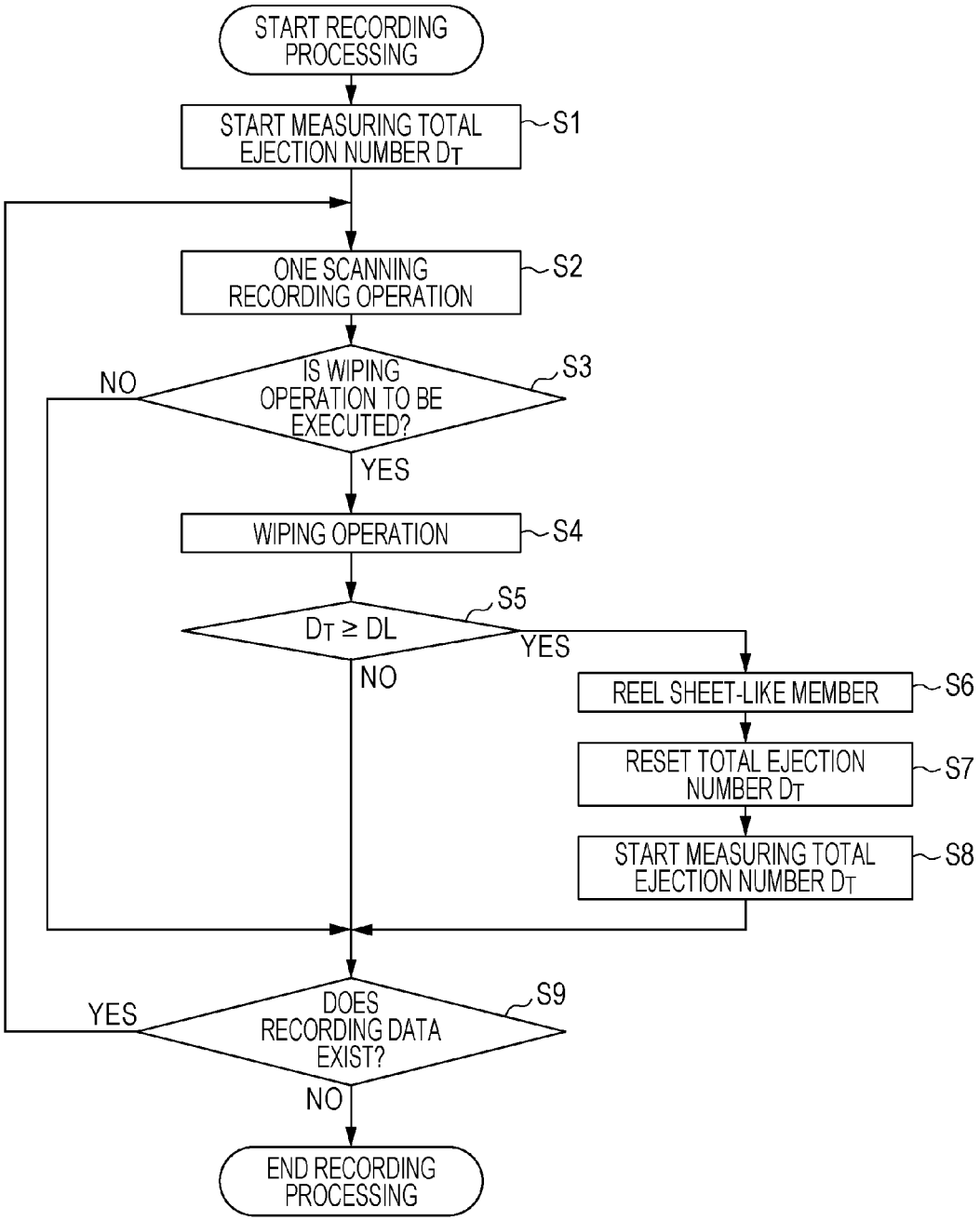

FIG. 7A is a flow chart of the wiping operation according to the first exemplary embodiment. First, when the recording operation is started, in step S1, a measurement of a total ejection number $D_T$ is started. The ejection number such as the total ejection number $D_T$ is an ejection number obtained by starting the measurement after the previous reeling operation of reeling the sheet-like member 31 by the reeling roller 32. Next, when the recording data for the one scanning is accumulated in the print buffer 121, the recording operation for the one scanning is performed in step S2. According to the present exemplary embodiment, first, the recording operation in the moving direction from the home position to the back position is performed by the recording head 9.

After the recording operation in step S2, it is determined whether or not the wiping operation is executed in step S3. According to the present exemplary embodiment, the wiping unit 30 is not provided at the back position. For this reason, the wiping operation by the recording head 9 is not executed after the recording operation in the moving direction from the home position to the back position by the recording head 9. Therefore, No is determined in step S3 for the first time, and the flow proceeds to step S9.

In step S9, it is checked whether or not the recording data exists. In a case where the recording data does not exist, No is determined in step S9, the recording processing is ended. In a case where the recording data exists, Yes is determined in step S9. The flow returns to step S2, and the recording operation is executed again.

The carriage 2 is positioned at the back position by the recording operation in step S2 for the first time. For this reason, in the recording operation in step S2 for the second time, the recording operation in the moving direction from the back position to the home position is performed by the recording head 9 mounted to the carriage 2. After that, it is determined whether or not the wiping operation is executed in step S3. After the recording operation in step S2 for the second time, the carriage 2 is located at the home position. For this reason, it is possible to execute the wiping operation by the recording head 9.

When it is determined that the wiping operation is executed in step S3, the flow proceeds to step S4, and the wiping operation is executed. After the wiping operation is executed in step S4, it is determined whether or not the total ejection number $D_T$ is higher than or equal to a wiping operation threshold DL of $2.0\times10^9$ in step S5. When the relationship of $D_T \geq DL$ is not established, that is, $D_T < DL$, the flow proceeds to step S9, and it is checked whether or not the recording data exists. When the relationship of $D_T \geq DL$ is established, that is, when $D_T$ is higher than or equal to the threshold DL, the flow proceeds to step S6, and the reeling operation of the sheet-like member 31 is executed.

In a case where the relationship of $D_T \geq DL$ is not established, it is determined that the wiping area of the sheet-like member 31 does not lose the wiping capability. Therefore, it is determined that the ejection opening surface 10 can be cleaned by the same wiping area again. Without executing the reeling operation of the sheet-like member 31 in step S6, the flow proceeds to step S9, and the recording operation is continued.

In a case where the relationship of $D_T \geq DL$ is established, it is determined that the wiping area of the sheet-like member 31 has already lost the wiping capability. Therefore, the ejection opening surface 10 is not cleaned by the same wiping area again. For this reason, by executing the reeling operation of the sheet-like member 31 in step S6, the wiping area where the wiping capability of the sheet-like member 31 has lost is collected. Subsequently, an unused site of the sheet-like member 31 is unreeled to the position facing the ejection opening surface 10 of the recording head 9 as the wiping area. The ejection opening surface 10 is wiped by this unused site of the sheet-like member 31.

After the sheet-like member 31 is reeled in step S6, the total ejection number $D_T$ that has been measured from step S1 is reset to 0 in step S7. After the total ejection number $D_T$ is reset in step S7, the measurement of the total ejection number $D_T$ is started again in step S8 similarly as in step S1.

Figure 7B:
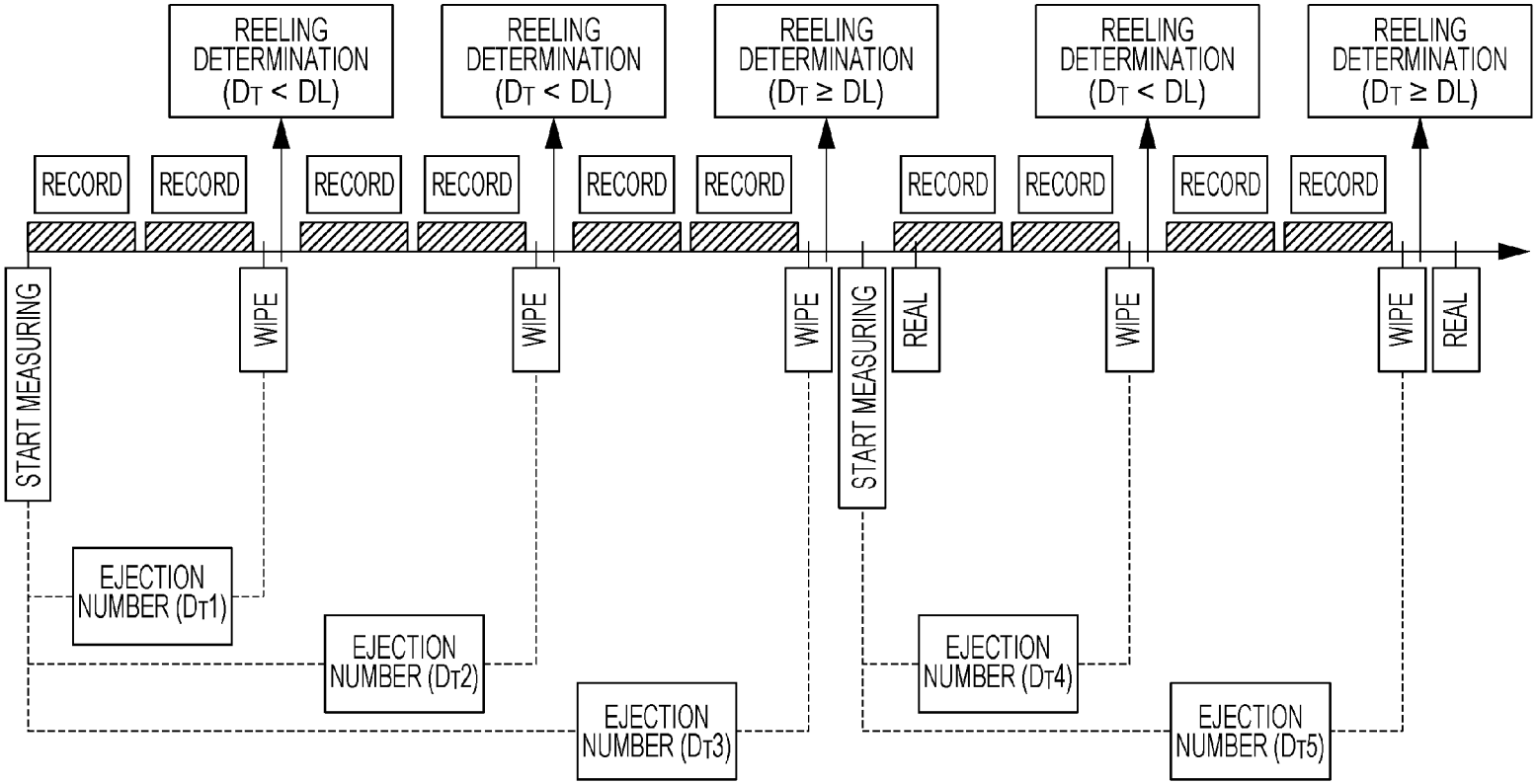

FIG. 7B is a schematic diagram of a reeling timing in a case where the flow chart of FIG. 7A is executed. As illustrated in FIG. 7B, according to the present exemplary embodiment, the reeling determination is performed every two recording operations based on the reciprocating scanning.

FIG. 7C is a table of the total ejection number $D_T$ after each reciprocating scanning, the wiping operation threshold DL, and the determination result of the reeling operation execution after each reciprocating scanning. The determination on the reeling operation execution is performed by comparing the wiping operation threshold DL with the total ejection number $D_T$ after each reciprocating scanning. As illustrated in FIG. 7A, when the relationship of $D_T \geq DL$ is established, the reeling operation is executed. When the relationship of $D_T \geq DL$ is not established, that is, $D_T < DL$, the reeling operation is not executed.

The total ejection number $D_T$1 after one reciprocation is $1\times10^9$, the total ejection number $D_T$2 after two reciprocations is $1.5\times10^9$, the total ejection number $D_T$4 after four reciprocations is $1.5\times10^9$. Since these values are all lower than the wiping operation threshold DL of $2.0\times10^9$, the reeling operation of the sheet-like member 31 is not executed.

In contrast to this, the total ejection number $D_T$3 after three reciprocations is $2.5\times10^9$, and the total ejection number $D_T$5 after five reciprocations is $3\times10^9$. Since these values are all higher than or equal to the wiping operation threshold DL of $2.0\times10^9$, the reeling operation of the sheet-like member 31 is executed after three and five reciprocations.

Second Exemplary Embodiment

According to the present exemplary embodiment, the reeling operation of the sheet-like member 31 is performed in accordance with each ejection number of the ink from each of the ejection opening columns 11 to 16 of the ejection opening surface 10. Components similar to those according to the first exemplary embodiment will be omitted for the following description.

The ink mist is deposited in the vicinity of the ejection opening that ejects the ink corresponding to the generation source of the ink mist. For this reason, the ink mist of the ink ejected by each of the ejection opening columns 11 to 16 itself is also deposited on the ejection opening surface 10 in the vicinity of each of the ejection opening columns 11 to 16. Therefore, along with the increase in the ejection number of the ink from each of the ejection opening columns 11 to 16, the contamination amount of the ejection opening surface 10 in the vicinity of each ejection opening column. According to the present exemplary embodiment, the contamination of the vicinity of each of the ejection opening columns 11 to 16 is estimated from the ejection number of each of the ejection opening columns 11 to 16.

Figure 8A:
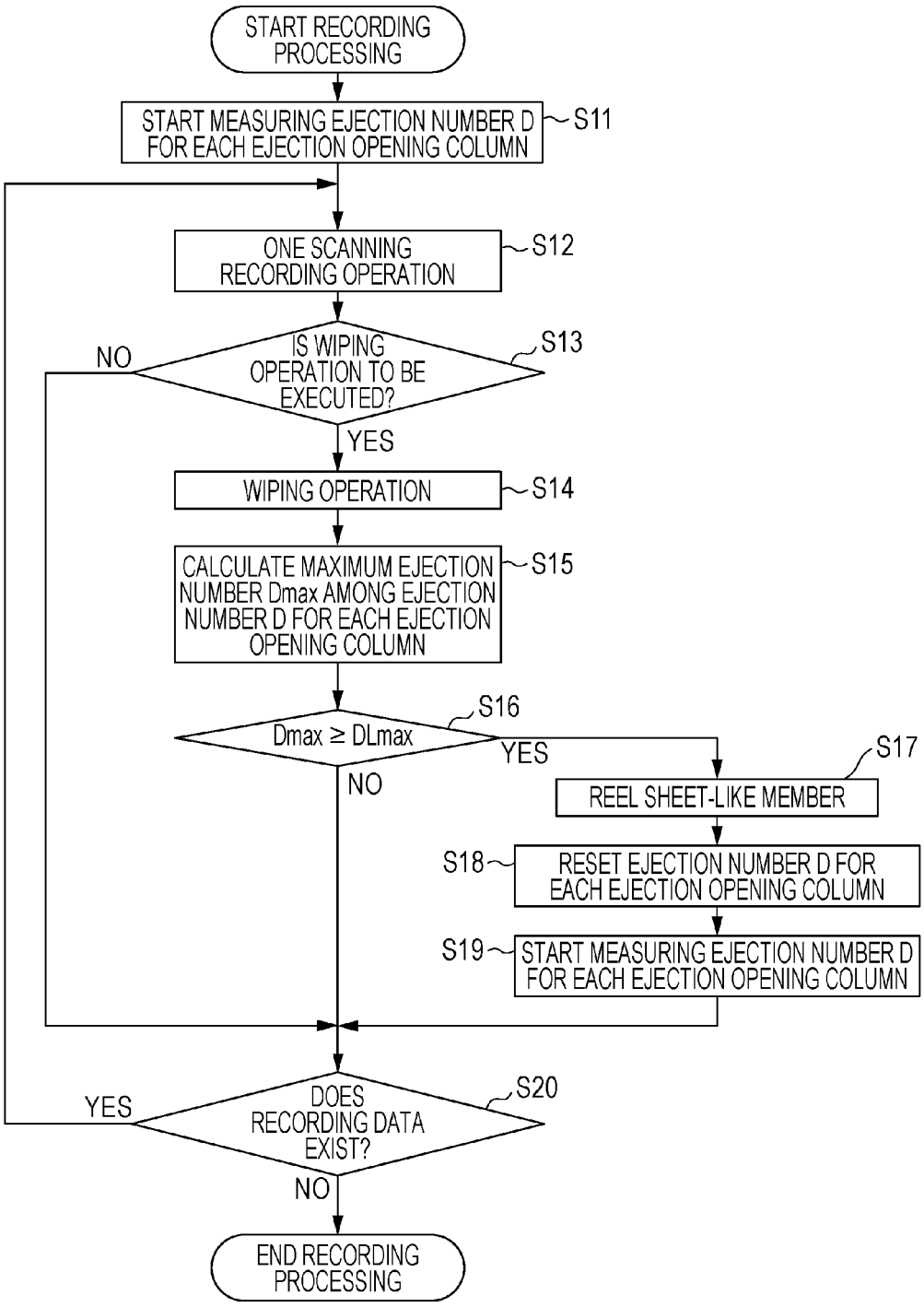

FIG. 8A is a flow chart of the recording processing operation according to the second exemplary embodiment. First, when the recording processing is started, in step S11, the measurement of the ejection number D for each ejection opening column is started, and the flow proceeds to step S12.

The steps related to the recording operation in steps S12 to S14 are similar to steps S2 to S4 of FIG. 7A. The step of checking whether or not the recording data exists in step S20 is similar to step S9 of FIG. 7A.

After the wiping operation in step S14, a maximum ejection number Dmax among the ejection numbers for the respective ejection opening columns is calculated in step S15. Next, in step S16, it is determined whether or not the maximum ejection number Dmax is higher than or equal to a wiping operation threshold DLmax of the ejection number for each ejection opening column. According to the present exemplary embodiment, the wiping operation threshold DLmax for the ejection numbers for the respective ejection opening columns is $5\times10^8$.

The processing after the determination in step S16 is similar to the processing after the determination in step S5 of FIG. 7A. The steps related to the reeling operation and the measurement of the ejection number in steps S17 to S19 are similar to step S6 to S8 of FIG. 7A.

Figure 8B:
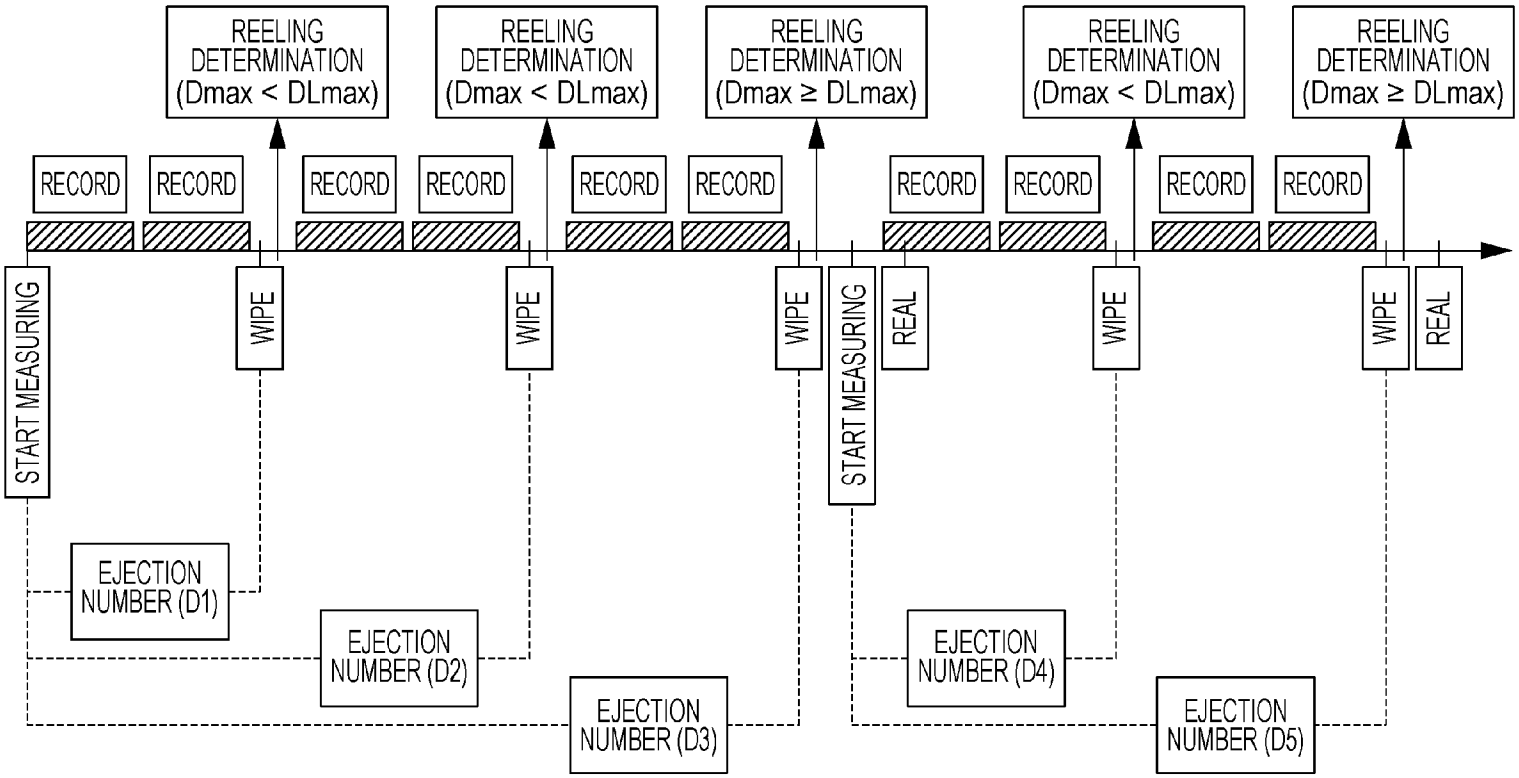

FIG. 8B is a schematic diagram of a reeling timing in a case where the flow chart of FIG. 8A is executed. As illustrated in FIG. 8B, according to the present exemplary embodiment, the reeling determination is performed every two recording operations by the reciprocating scanning.

FIG. 8C is a table of the maximum ejection number Dmax after each reciprocating scanning, the wiping operation threshold DLmax of the ejection number of the ejection opening column of each color, and the determination result of the reeling operation execution after each reciprocating scanning. Since ink of a different color is ejected for each ejection opening column, the ejection number of each color represents the ejection number for each ejection opening column. The determination on the reeling operation execution is performed by comparing the wiping operation threshold DLmax with the maximum ejection number Dmax after each reciprocating scanning similarly as in the reeling operation execution determination of FIG. 7C. As illustrated in FIG. 8A, when the relationship of Dmax≥DLmax is established, the reeling operation is executed. When the relationship of Dmax≥DLmax is not established, that is, Dmax<DLmax, the reeling operation is not executed.

The maximum ejection number Dmax after the one reciprocation is $5\times10^7$, the maximum ejection number Dmax after the two reciprocations is $2.5\times10^8$, and the maximum ejection number Dmax after the four reciprocations is $1.5\times10^8$. Since these values are all lower than the wiping operation threshold DLmax of $5\times10^8$, the reeling operation of the sheet-like member 31 is not executed.

In contrast to this, the maximum ejection number Dmax after the three reciprocations is $5.5\times10^8$, the maximum ejection number Dmax after the five reciprocations is $5\times10^8$. Since these values are all higher than or equal to the wiping operation threshold DLmax of $5\times10^8$, the reeling operation of the sheet-like member 31 is executed after the three reciprocations and the five reciprocations.

According to the present exemplary embodiment, the contamination on the part for wiping each ejection opening column is determined on the basis of the ejection number D of the ink of each ejection opening column, and the reeling operation is executed in accordance with the determination result. For that reason, it is possible to execute the reeling operation at a more appropriate timing.

Third Exemplary Embodiment

According to the present exemplary embodiment, the reeling operation of the sheet-like member 31 is performed in accordance with the ink ejection number for each area obtained by dividing the ejection opening surface 10 in a direction intersecting with the wiping direction. Components similar to those according to the first and second exemplary embodiments will be omitted for the following description.

Each of the areas obtained by dividing the ejection opening surface 10 is contaminated by the ink mist of the ink ejected by the ejection opening itself provided in the corresponding divided area. Therefore, the contamination amount on each divided area is increased along with the increase in the ejection number of the ink from the ejection opening on the divided area. According to the present exemplary embodiment, the contamination on each divided area is estimated from the ejection number the ejection opening on the divided area.

Figure 9A:
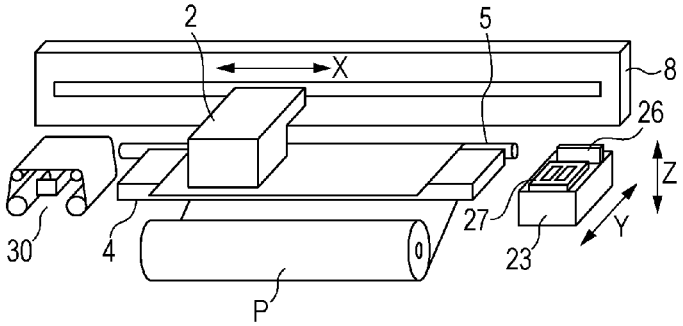
FIGS. 9A to 9D are schematic diagrams of an internal mechanism and a wiping operation of the inkjet recording apparatus.

FIG. 9A is a schematic diagram of an internal configuration of the inkjet recording apparatus 1. According to the present exemplary embodiment, the recovery unit 23 is arranged at the home position, and the wiping unit 30 is arranged at the back position. When the carriage 2 is moved on an extension line extending from the platen 4 along the main scanning direction X, the wiping unit 30 wipes the ejection opening surface 10 of the recording head 9. The wiping unit 30 performs the wiping operation in a direction intersecting with the ejection opening columns 11 to 16 (a direction intersecting with the array direction of the ejection openings 11*a*, an array direction of the ejection opening columns).

Figure 9B:
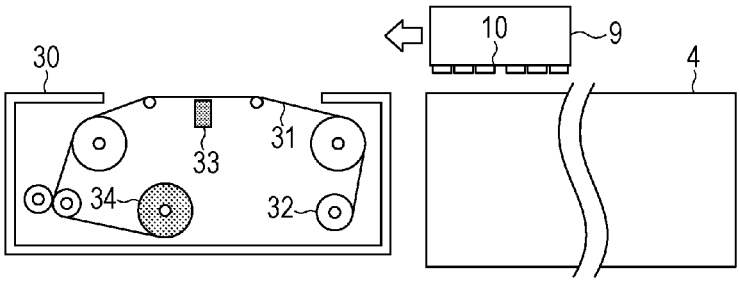
Figure 9C:
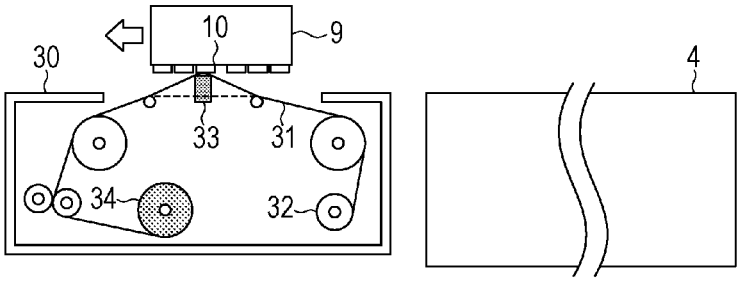
Figure 9D:
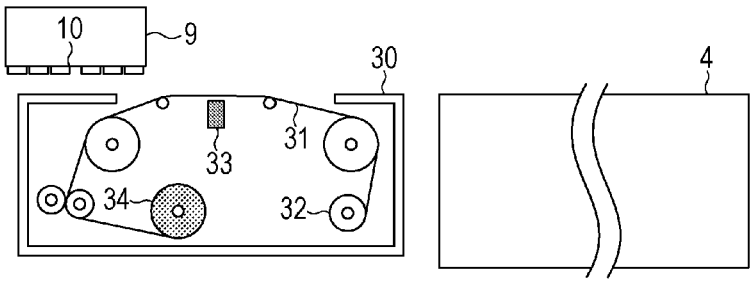

FIGS. 9B to 9D are schematic diagrams of the wiping operation by the wiping unit 30.

When it is determined that the recording data for the one scanning is accumulated in the print buffer 121, while the carriage 2 is moved from the home position to the back position, the recording operation for the one scanning is executed. According to the present exemplary embodiment, since the wiping unit 30 is arranged at the back position, after the recording operation by the recording head 9 from the home position to the back position is performed, the wiping operation by the recording head 9 is executed. After the wiping operation, when it is determined that the recording data for the next one scanning is accumulated in the print buffer 121, while the carriage 2 is moved from the back position to the home position, the recording operation for the next one scanning is executed.

In the wiping operation according to the present exemplary embodiment, first, as illustrated in FIG. 9B, the recording head 9 is moved from a position above the platen 4 to a position above the wiping unit 30. Next, as illustrated in FIG. 9C, the abutting member 33 is elevated from an evacuating position, and the abutting member 33 is fixed at an elevated position where the sheet-like member 31 can contact the ejection opening surface 10. Subsequently, by moving the recording head 9 in a state in which the abutting member 33 is fixed at the elevated position, the ejection opening surface 10 is wiped by the sheet-like member 31. At this time, until the ejection opening surface 10 of the recording head 9 passes through the abutting member 33, the abutting member 33 is fixed at the elevated position. As illustrated in FIG. 9D, after the ejection opening surface 10 passes through the abutting member 33, the abutting member 33 is lowered from the elevated position to the evacuating position.

Figure 10:
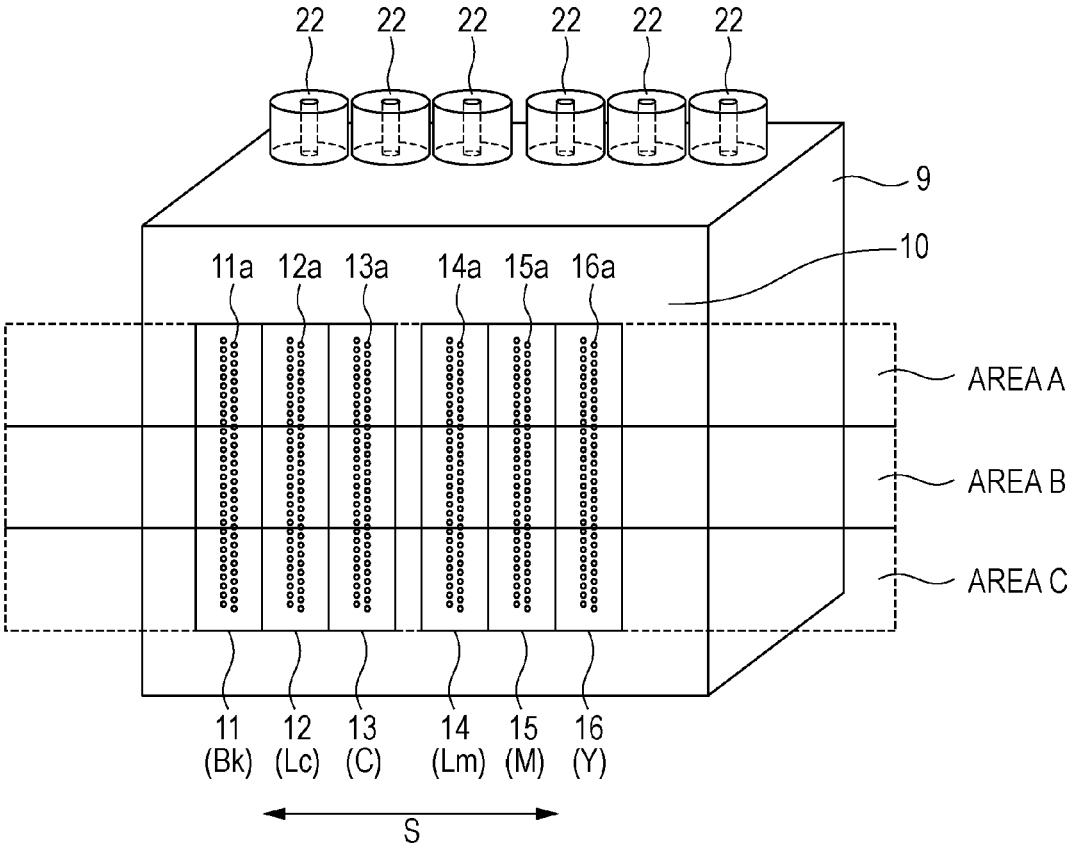
FIG. 10 illustrates a state in which an area of an ejection opening surface of a recording head is divided according to a third exemplary embodiment.

FIG. 10 illustrates a state in which the ejection opening surface 10 is divided in 3 into an area A, an area B, and an area C. According to the present exemplary embodiment, the ejection number of the ink ejected from the ejection opening provided to each divided area is obtained.

Figure 11A:
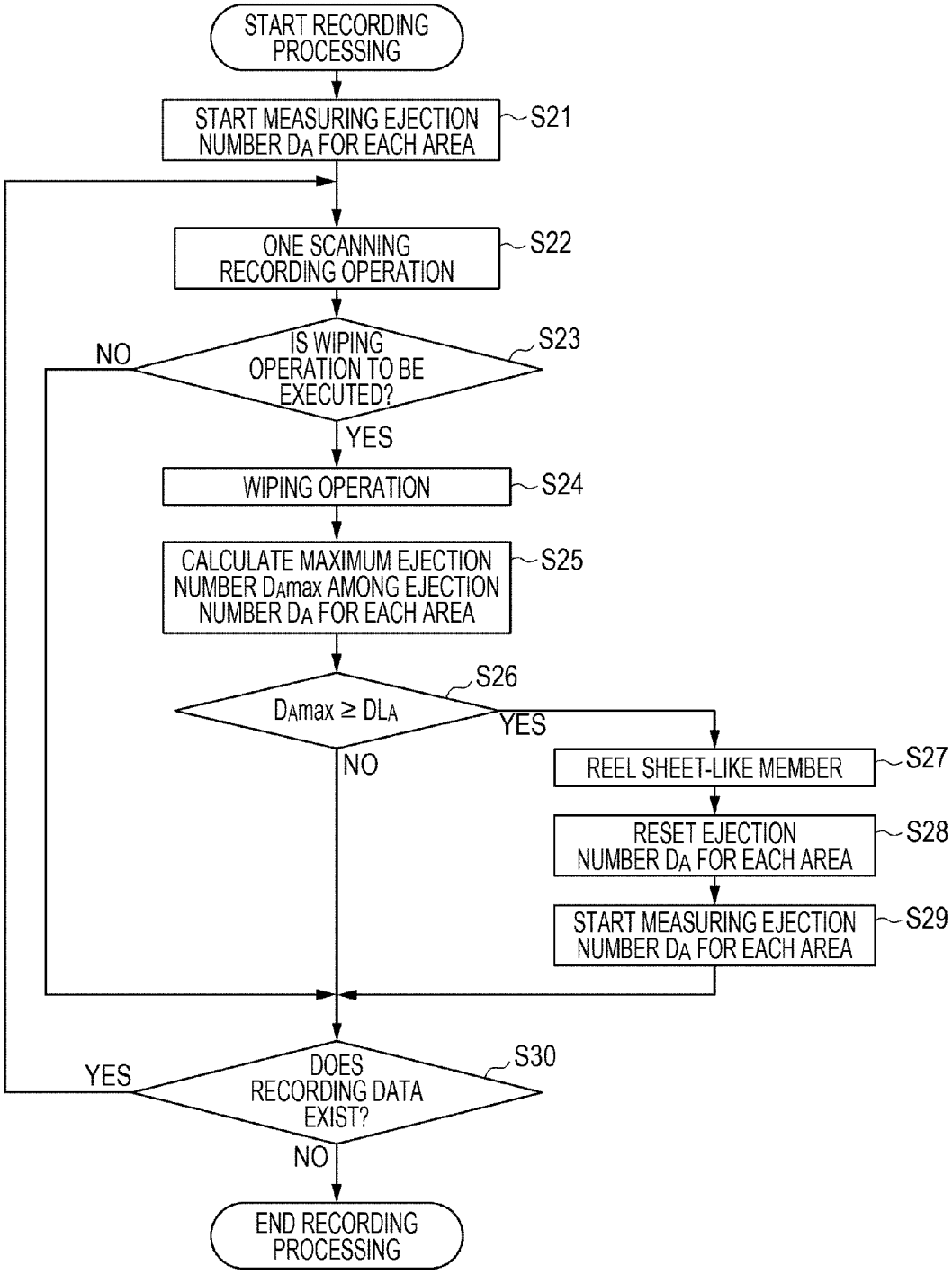

FIG. 11A is a flow chart of the wiping operation according to the present exemplary embodiment. First, when the recording processing is started, in step S21, the measurement of the ejection number $D_A$ of each area is started. Next, when the recording data for the one scanning is accumulated in the print buffer 121, in step S22, the recording operation for the one scanning is performed. In step S22, the recording operation by the recording head 9 in the moving direction from the home position to the back position is performed, and the flow proceeds to step S23.

In step S23, it is determined whether or not the wiping operation of the recording head 9 is executed. According to the present exemplary embodiment, since the wiping unit 30 is located at the back position, the wiping operation by the recording head 9 is executed after the recording operation in the moving direction from the home position to the back position by the recording head 9. Therefore, Yes is determined in step S23 for the first time, and the flow proceeds to step S24.

After the wiping operation is executed in step S24, the flow proceeds to step S25. In step S25, a maximum ejection number $DL_A$max is calculated among the ejection numbers of the respective areas. Next, in step S26, it is determined whether or not a maximum ejection number $D_A$max is higher than or equal to the wiping operation threshold $DL_A$max of $2\times10^{10}$.

The processing after the determination in step S26 is similar to the processing after the determination in step S5 of FIG. 7A. The steps related to the reeling operation and the measurement of the ejection number in steps S27 to S29 are similar to steps S6 to S8 of FIG. 7A. The step of checking whether or not the recording data exists in step S30 is similar to step S9 of FIG. 7A.

Figure 11B:
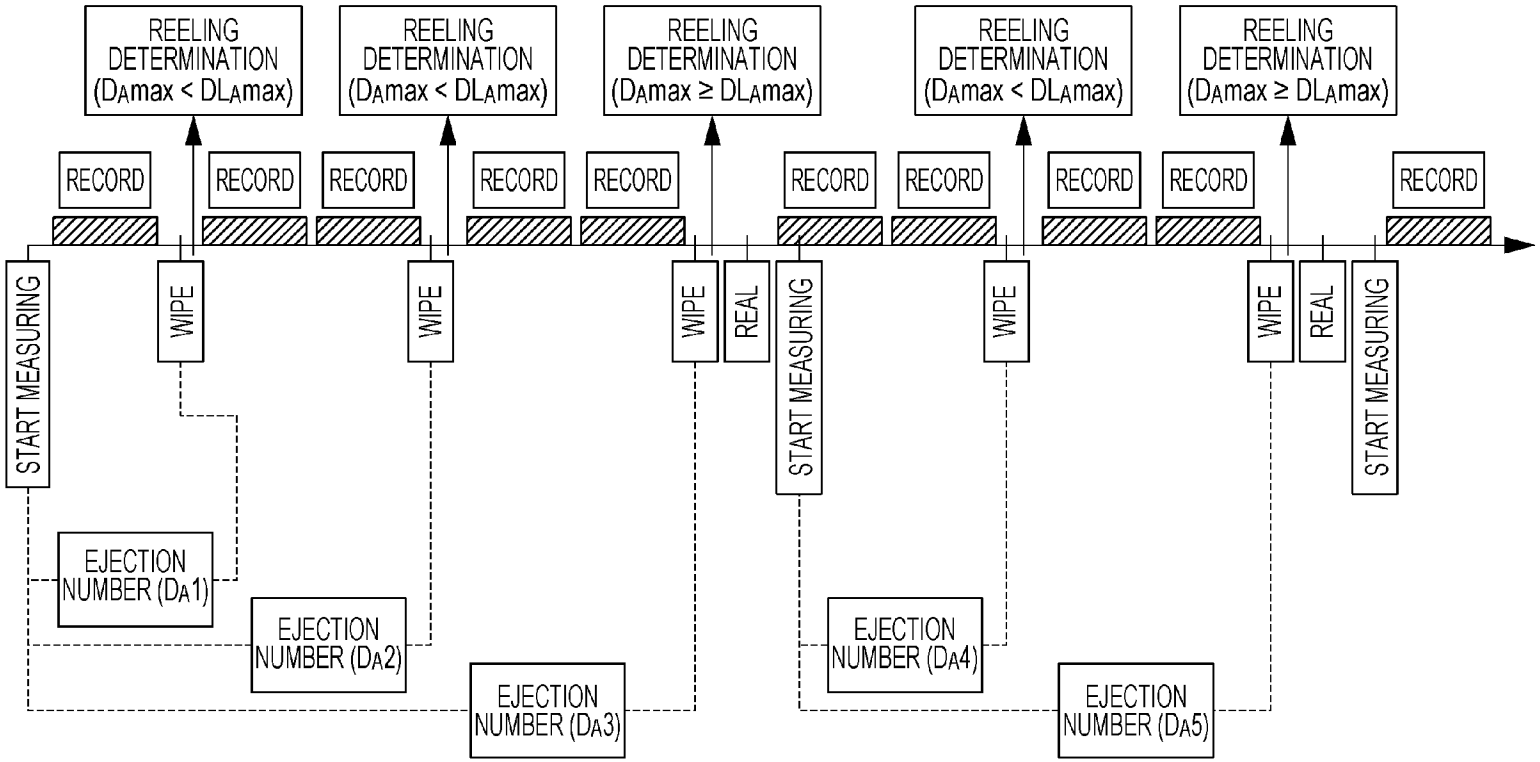

FIG. 11B is a schematic diagram of a reeling timing in a case where the flow chart of FIG. 11A is executed. In FIG. 11B, after the recording operation based on the movement from the home position to the back position by the carriage 2 for the first time, the reeling determination is performed. After the first scanning, the reeling determination is performed for every two recording operations based on one reciprocating scanning.

FIG. 11C is a table of the maximum ejection number $D_A$max after each reciprocating scanning, the wiping operation threshold $DL_A$max, and the determination result of the reeling operation execution after each reciprocating scanning. The determination on the reeling operation execution is performed by comparing the wiping operation threshold $DL_A$max with the maximum ejection number $D_A$max after each reciprocating scanning. As illustrated in FIG. 11A, when the relationship of $D_A$max≥$DL_A$max is established, the reeling operation is executed. When the relationship of $D_A$max≥$DL_A$max is not established, that is, $D_A$max<$DL_A$max, the reeling operation is not executed.

$D_A$max of the maximum ejection number $D_A$1 after the one reciprocation is $5\times10^9$, $D_A$max of the maximum ejection number $D_A$2 after the two reciprocations is $1\times10^{10}$, and $D_A$max of the maximum ejection number $D_A$4 after the four reciprocations is $1.5\times10^{10}$. Since these values are all lower than the wiping operation threshold $DL_A$max of $2\times10^{10}$, the reeling operation of the sheet-like member 31 is not executed.

In contrast to this, $D_A$max of the maximum ejection number $D_A$3 after the three reciprocations is $6\times10^{10}$, and $D_A$max of the maximum ejection number $D_A$5 after the five reciprocations is $5\times10^{10}$. Since these values are all higher than or equal to the wiping operation threshold $DL_A$max of $2\times10^{10}$, the reeling operation of the sheet-like member 31 is executed after the three reciprocations and the five reciprocations.

According to the present exemplary embodiment, the determination on the contamination on the wiping part is made on the basis of the ejection number $D_A$ of the ink for each divided area, and the reeling operation is executed in accordance with the determination result. For that reason, it is possible to execute the reeling operation at an appropriate timing in a so-called lateral wiping configuration.

Fourth Exemplary Embodiment

According to the present exemplary embodiment, the reeling operation is performed in accordance with the ink consumption consumed in the recording operation. Components similar to those according to the first to third exemplary embodiments will be omitted for the following description.

Figure 12:
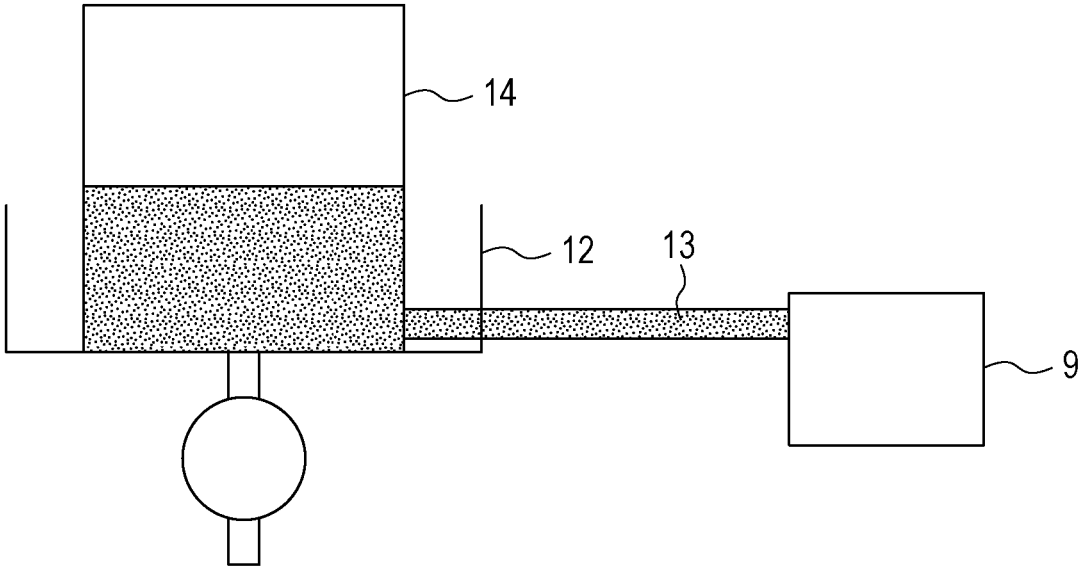
FIG. 12 is a schematic diagram of configurations of a recording head and an ink tank.

FIG. 12 illustrates configurations of the recording head and the ink tank according to the exemplary embodiment of the present invention. The ink tank 14 is connected to the recording head 9 via the tube 13. The ink is supplied from the ink tank 14 to the recording head 9 via the tube 13.

The ink consumption is obtained from a weight change of the ink tank 14 which is caused by the recording operation. The weight change of the ink tank 14 is obtained by the weighing scale 12 arranged on a bottom surface of the ink tank 14. The weight of the ink tank 14 is measured by the weighing scale 12 before and after the recording operation, and the weight of the ink in the ink tank 14 which has been reduced by the recording operation is obtained. The weight of the ink which has been reduced by the recording operation is set as the ink consumption consumed in the recording operation.

This ink consumption is not limited to the weight of the ink and may be a volume of the ink which is calculated from the weight of the ink. In addition, the ink consumption may also be a volume of the ink which is obtained by multiplying the ejection number of ink droplets by the volume of the ink droplet. Moreover, a configuration may also be adopted in which a large number of pins for detecting the remaining amount are provided to the ink tank 14 so that a height of the ink liquid level may finely be obtained. In this configuration, the volume of the ink consumption is obtained from the height change of the ink liquid level detected by the pins and the cross-sectional area of the ink tank 14.

Figure 13:
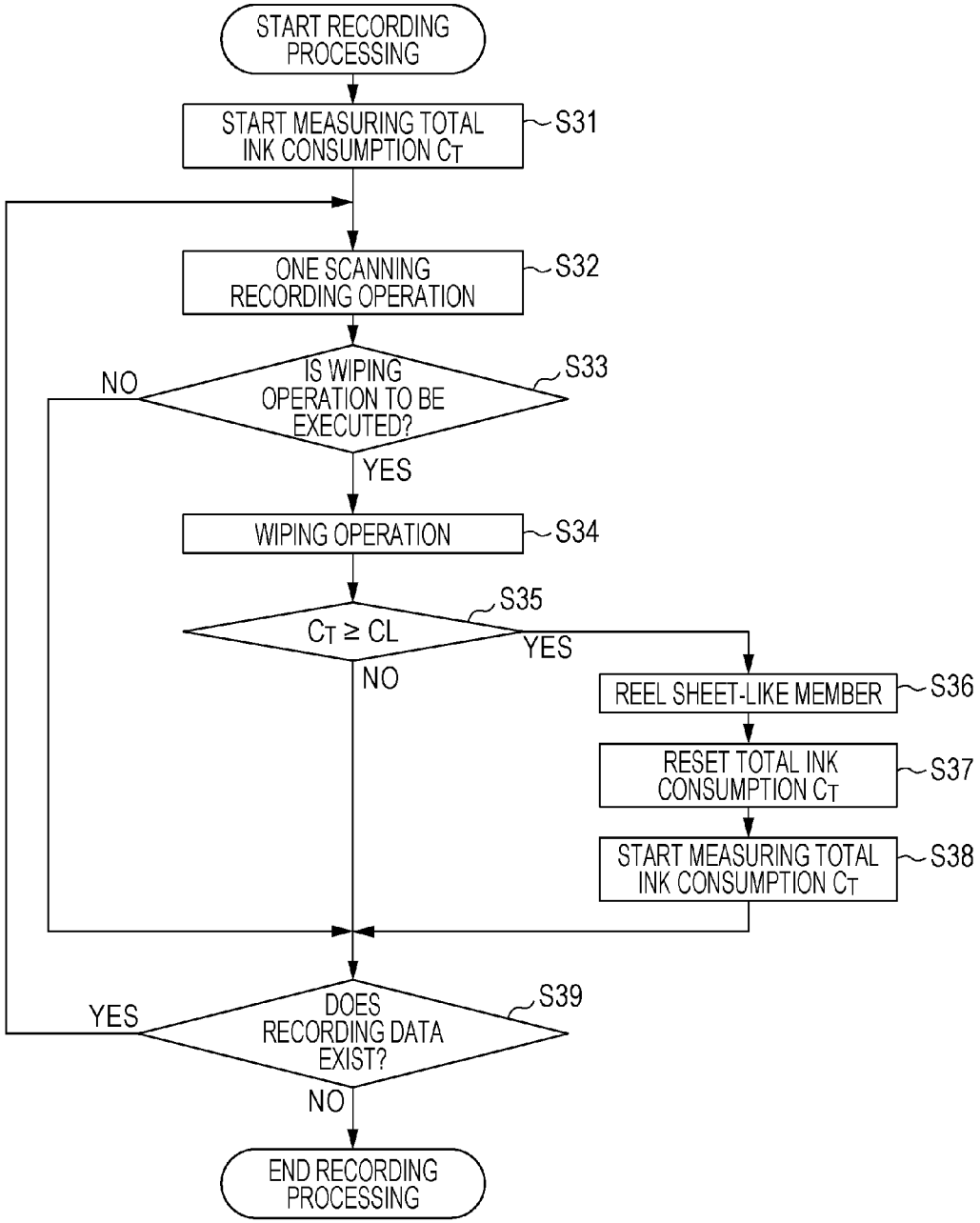
FIG. 13 is a flow chart of a wiping operation according to a fourth exemplary embodiment.

FIG. 13 is a flow chart of the wiping operation according to the present exemplary embodiment. When the recording processing is started, in step S31, a measurement of a total ink consumption CT is started, and the flow proceeds to step S32. The total ink consumption CT is an ink usage amount consumed in the recording operation.

The steps related to the recording operation in steps S32 to S34 are similar to steps S2 to S4 of FIG. 7A. The step of checking whether or not the recording data exists in step S39 is similar to step S9 of FIG. 7A. After the wiping operation is executed in step S34, it is determined whether or not the total ink consumption CT is higher than or equal to an ink consumption threshold CL in step S35.

The processing after the determination in step S35 is similar to the processing after the determination in step S5 of FIG. 7A. The steps related to the reeling operation and the measurement of the total ink consumption in steps S36 to S38 are similar to steps S6 to S8 related to the reeling operation of FIG. 7A and the measurement of the total ejection number. When a relationship of CT≥CL is not established, that is, CT<CL, the flow proceeds to step S39, and it is checked whether or not the recording data exists. When the relationship of CT≥CL is established, the flow proceeds to step S36, and the reeling operation of the sheet-like member 31 is executed.

The ink consumption threshold CL is determined through a method similar to the method of determining the wiping operation threshold DL from FIG. 6B. The ink consumption consumed in the recording operation is measured for each reciprocating scanning of the carriage 2, and the reciprocation number at which the recording head 9 loses the wiping capability after the reciprocating scanning is examined. A value with regard to the ink consumption at a time of the reciprocation number where the wiping capability is still present immediately before the reciprocation number at which this wiping capability is lost is determined as the ink consumption threshold CL while an error of the timing for the wiping operation is taken into account.

The configuration is not limited to the ejection number of the ink according to the present exemplary embodiment, but also the reeling operation of the sheet-like member 31 can appropriately be controlled in accordance with the ink consumption.

Other Exemplary Embodiments

Exemplary embodiments of the present invention can widely be applied to various inkjet recording apparatuses configured to recording an image by using a recording head that can eject ink from an ejection opening. Therefore, the inkjet recording apparatus is not limited to the apparatus including a serial head and may also be an apparatus including a line head.

The ejection number is not limited to the ejection number of the ink actually ejected from the recording head 9 and may also be an ejection number estimated from the recorded image data. For example, the ejection number may be an ejection number estimated from RGB data or CMYK data of the recorded image or the like.

In addition, the configuration of changing the site corresponding to the wiping area of the wiping member according to the exemplary embodiments of the present invention is not limited to the configuration of reeling the sheet-like member. For example, a configuration of cutting and collecting the contaminated site instead of reeling the contaminated site of the sheet-like member may also be adopted.

It is noted that the generation amount of the ink mist varies depending on a distance between the recording head and the recording medium, a humidity, a block driving order, an ink type, a drop measure of one ink droplet, an ejection frequency, and a speed of the recording head. For this reason, the value related to the ink amount may also be corrected by taking these parameters into account.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-103450, filed 15 May, 2013, which is hereby incorporated by reference wherein in its entirety.

What is claimed is:

1. An inkjet recording apparatus comprising:

an inkjet recording head including an ejection opening surface from which ink is ejected;

a wiping unit having a sheet-like member, a reeling roller for reeling the sheet-like member, and an abutting member for pressing up the sheet-like member such that the sheet-like member abuts against the ejection opening surface, wherein the wiping unit wipes the ejection opening surface by relatively moving the ejection opening surface and the wiping unit in a state in which the sheet-like member abuts against the ejection opening surface;

a changing unit configured to perform a changing operation for moving an unused wiping area of the sheet-like member to a position facing the ejection opening surface by the reeling roller;

an obtaining unit configured to obtain a value related to an ink amount ejected from the inkjet recording head; and a control unit configured to cause the changing unit to perform the changing operation on the basis of the value related to the ink amount which is obtained by the obtaining unit.

2. The inkjet recording apparatus according to claim 1, further comprising:

an ink tank that holds ink to be supplied to the inkjet recording head, wherein the obtaining unit obtains an ink usage amount used from the ink tank, and the value related to the ink amount is the ink usage amount.

3. The inkjet recording apparatus according to claim 1, wherein the value related to the ink amount is an ejection number of ink droplets ejected from the inkjet recording head.

4. The inkjet recording apparatus according to claim 3, wherein the ejection number is an ejection number of the ink droplets ejected from the inkjet recording head after the previous changing operation.

5. The inkjet recording apparatus according to claim 1, wherein the control unit causes the changing unit to perform the changing operation when the value related to the ink amount is higher than or equal to a threshold.

6. The inkjet recording apparatus according to claim 1, wherein the control unit controls the changing unit on the basis of a value related to an ink amount for each of areas obtained by dividing the ejection opening surface in a direction intersecting with a wiping direction of the wiping unit.

7. The inkjet recording apparatus according to claim 6, wherein the control unit causes the changing unit to perform the changing operation when the value related to the ink amount for each divided area is higher than or equal to a threshold.

8. The inkjet recording apparatus according to claim 6, wherein a plurality of ejection opening columns where a plurality of ejection openings are arranged along a predetermined direction on the ejection opening surface are provided, and wherein the wiping direction is the predetermined direction.

9. The inkjet recording apparatus according to claim 8, wherein the plurality of ejection opening columns eject two or more types of ink.

10. The inkjet recording apparatus according to claim 6, wherein a plurality of ejection opening columns where a plurality of ejection openings are arranged along a predetermined direction on the ejection opening surface are provided, and wherein the wiping direction is a direction intersecting with the predetermined direction.

11. The inkjet recording apparatus according to claim 10, wherein the plurality of ejection opening columns eject two or more types of ink.

12. The inkjet recording apparatus according to claim 1, wherein the control unit corrects the value related to the ink amount on the basis of a size of an ink drop ejected from the inkjet recording head.

13. The inkjet recording apparatus according to claim 1, wherein the wiping unit is a sheet-like member, and wherein the changing unit moves an unused wiping area to a position facing the ejection opening surface.

14. The inkjet recording apparatus according to claim 1, wherein the sheet-like member is composed of at least one of urethane foam, melamine foam, polyolefin, PET, and nylon.

15. The inkjet recording apparatus according to claim 1, wherein the sheet-like member is impregnated with wiping solution including at least one of water, surfactant, and solvent.

16. The inkjet recording apparatus according to claim 1, wherein the inkjet recording head ejects the ink by heat generated by a heater.

17. The inkjet recording apparatus according to claim 1, wherein the ink ejected from the inkjet recording head is fixed on a recording medium by heat.

18. The inkjet recording apparatus according to claim 1, wherein the control unit corrects the value related to the ink amount in accordance with a type of ink.

19. A control method for a wiping unit in an inkjet recording apparatus that includes an inkjet recording head including an ejection opening surface from which ink is ejected, and the wiping unit having a sheet-like member, a reeling roller for reeling the sheet-like member, and an abutting member for pressing up the sheet-like member such that the sheet-like member abuts against the ejection opening surface, the control method comprising:

wiping the ejection opening surface by relatively moving the ejection opening surface and the wiping unit in a state in which the sheet-like member abuts against the ejection opening surface;

obtaining a value related to an ink amount ejected from the inkjet recording head; and moving an unused wiping area of the sheet-like member to a position facing the ejection opening surface by the reeling roller on the basis of the value related to the ink amount obtained in the obtaining step.

* * * * *